US010383370B2

(12) United States Patent
Wendt Thevenaz et al.

(10) Patent No.: US 10,383,370 B2
(45) **Date of Patent: *Aug. 20, 2019**

(54) ELECTRONIC CIGARETTE HAVING REUSABLE BASE WITH HEATING ELEMENT

(71) Applicant: MD&C CREATIVE MAISON SA, Genève (CH)

(72) Inventors: Cristina Wendt Thevenaz, Geneva (CH); Maria Daniele Killy, Geneva (CH); Tom Fournier, Lyons (FR)

(73) Assignee: MD&C CREATIVE MAISON SA, Geneva (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/748,549

(22) PCT Filed: Apr. 7, 2017

(86) PCT No.: PCT/IL2017/050429

§ 371 (c)(1),
(2) Date: Jan. 29, 2018

(87) PCT Pub. No.: WO2017/179043

PCT Pub. Date: Oct. 19, 2017

(65) Prior Publication Data

US 2018/0213846 A1 Aug. 2, 2018

Related U.S. Application Data

(60) Provisional application No. 62/321,807, filed on Apr. 13, 2016.

(51) Int. Cl.
*A24F 13/00* (2006.01)
*A24F 17/00* (2006.01)
(Continued)

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/00; A24F 47/002; A24F 47/006; A24F 47/008; A24F 47/004
(Continued)

(56) References Cited

U.S. PATENT DOCUMENTS 5,666,977 A 9/1997 Higgins et al.
8,251,060 B2 8/2012 White et al.
(Continued)

FOREIGN PATENT DOCUMENTS

EP 2965642 A1 1/2016
RU 103281 U1 4/2011
(Continued)

OTHER PUBLICATIONS

International Search Report for International Patent Application No. PCT/IL2017/050429, issued from the European Patent Office, dated Jul. 17, 2017, 3 pages.
(Continued)

*Primary Examiner* — Abdullah A Riyami
*Assistant Examiner* — Thang H Nguyen
(74) *Attorney, Agent, or Firm* — Kilyk & Bowersox, P.L.L.C.

(57) ABSTRACT

An electronic cigarette comprising a base part and a cartridge configured to be assembled thereto, said base part comprising a battery and at least one heating element connected to the battery, and said cartridge comprising: a substance chamber configured for containing therein a substance to be smoked, said substance chamber comprising a substance outlet; a vaporization chamber in communication with the substance outlet for receiving said substance therein; and at least one heat transfer unit configured, at least
(Continued)

when the cartridge is assembled to the base part, for being heated by the heating element of the base part and for heating the substance being provided via said substance outlet for its vaporization in the vaporization chamber.

20 Claims, 3 Drawing Sheets

(51) Int. Cl.
*A24F 25/00* (2006.01)
*A24F 47/00* (2006.01)
*H05B 1/02* (2006.01)

(58) Field of Classification Search
USPC ..... 131/329, 328
See application file for complete search history.

(56) References Cited

U.S. PATENT DOCUMENTS

2011/0036346 A1* 2/2011 Cohen ..... A61M 11/042 128/200.14
2013/0160765 A1 6/2013 Liu
2014/0000638 A1 1/2014 Sebastian et al.
2014/0109921 A1* 4/2014 Chen ..... A24F 47/008 131/273
2014/0123989 A1 5/2014 LaMothe
2015/0034103 A1* 2/2015 Hon ..... H05B 3/22 131/328
2015/0053220 A1 2/2015 Levy et al.
2015/0090279 A1* 4/2015 Chen ..... A61M 15/06 131/329
2015/0201674 A1* 7/2015 Dooly ..... B65B 5/06 53/432
2015/0209530 A1 7/2015 White
2016/0135505 A1 5/2016 Li et al.
2017/0042251 A1 2/2017 Yamada et al.
2017/0258140 A1* 9/2017 Rostami ..... A24F 47/008
2017/0295844 A1 10/2017 Thevenaz et al.

FOREIGN PATENT DOCUMENTS

RU 138386 U1 3/2014
WO 2013155645 A1 10/2013
WO 2014110119 A1 7/2014
WO 2015028891 A2 3/2015
WO 2015043126 A1 4/2015
WO 2015101479 A1 7/2015

OTHER PUBLICATIONS

Written Opinion of the International Searching Authority for International Patent Application No. PCT/IL2017/050429, issued from the European Patent Office, dated Jul. 17, 2017, 7 pages.
Non-Final Office Action for commonly owned U.S. Appl. No. 15/481,081, dated Jun. 22, 2018, 11 pages.
Decision to Grant for Japanese Patent Application No. JP 2018-505469, issued by the Japan Patent Office, dated Aug. 21, 2018, 3 pages.
Decision to Grant for Russian Patent Application No. 2018139704/12(065917), issued by the Russian Federation Federal Service for Intellectual Property, dated Mar. 26, 2019, 9 pages.

* cited by examiner

ELECTRONIC CIGARETTE HAVING REUSABLE BASE WITH HEATING ELEMENT

TECHNOLOGICAL FIELD

The present application is directed to an electronic cigarette, in particular, an electronic cigarette comprising a heating element in the reusable part, and including additional user features.

BACKGROUND

Electronic cigarettes have become quite common in recent years in replacing regular cigarettes, providing a healthier alternative to common tobacco-based substances without considerably affecting the smoking experience.

An electronic cigarette commonly comprises a base part accommodating all the operating components of the electronic cigarette (processor, battery etc.), and a disposable part which contains the smoked substance filling, and which is discarded/refilled after a given period of use.

In general, the base part comprises the core components of the electronic cigarette which are configured for vaporizing the smoked substance which resides, in a liquid state, in the disposable part. For this purpose, a heating element (e.g., a coil) is commonly implemented in the disposable part which is electrically wired to the battery once the disposable part and base part are assembled, and which is configured for transferring heat to the smoked substance for the purpose of its vaporization.

Exemplary patents dealing with heating element in the cartridge are based on:

- heating element in atomizing component in cartridge pipe (Shenzhen smoore technology Ltd., Electronic cigarette, WO2015043126);
- heating element and e-liquid to constitute the atomizer (SIS Resources Ltd. WO2015028891); and
- two heating elements gathering in the same area (the aerozolisation zone) 2 vaporized liquids from 2 different reservoirs. Transport elements are entangled with heating element, and create the aerozolisation zone. (R. J. Reynolds Tobacco Co. US 2014/0000638).

Exemplary patents dealing with heating in the disposable part are based on impregnation of a mesh and/or roving with e-liquid and heat it by a separated heated coiled. Heated coil is placed in a disposable part (with the battery) and the cartridge is in the disposable part. Hence there is no vaporization chamber (distance between mesh and liquid storage, see Ruyan investment holdings Ltd., Electronic cigarette WO2013155645).

Acknowledgement of the above references herein is not to be inferred as meaning that these are in any way relevant to the patentability of the presently disclosed subject matter.

GENERAL DESCRIPTION

In accordance with one aspect of the subject matter of the present application, there is provided an electronic cigarette comprising a base part and a cartridge configured to be assembled thereto, said base part comprising: a battery and at least one heating element connected to the battery, and said cartridge comprising a substance chamber configured for containing therein a substance to be smoked, said substance chamber comprising a substance outlet; a vaporization chamber in communication with the substance outlet for receiving said substance therein; and at least one heat transfer unit configured, at least when the cartridge is assembled to the base part, for being heated by the heating element of the base part and for heating to the substance being provided via said substance outlet for its vaporization in the vaporization chamber.

In accordance with another aspect of the subject matter of the present application, there is provided a cartridge for an electronic cigarette, said cartridge being configured to be assembled with a base part of the electronic cigarette having a battery and at least one heating element connected to the battery, said cartridge comprising: a substance chamber configured for containing therein a substance to be smoked, said substance chamber comprising a substance outlet; a vaporization chamber in communication with the substance outlet for receiving said substance therein; and at least one heat transfer unit configured, at least when the cartridge is assembled to the base part, for being heated by the heating element of the base part and for heating the substance being provided via said substance outlet for its vaporization in the vaporization chamber.

The substance to be smoked will hereinafter be referred to as 'smoked substance'. It should be understood that the term 'smoked substance' does not necessitate actual smoking and merely refers to the substance (e.g., liquid) which, eventually, may be vaporized for providing the user with a smoking experience.

Under the above arrangement, the heating element does not come into direct contact with the substance chamber and, more importantly, with the smoked substance itself.

The cartridge can further comprise a sorption member at least partially disposed within the vaporization chamber. Under such a design, the heat is delivered from the heat transfer unit to the sorption member by conduction.

The sorption member can be made of any material or a combination of materials being able to perform sorption and/or absorption of another material, and can be made, for example, of one or more of the following materials: fiber, glass, aluminum, cotton, ceramic, cellulose, glass fiber wick, stainless steel mesh, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX, etc.

The heat transfer unit can have a first side configured, when the cartridge is assembled to the base part, for interfacing the heating element for receiving heat therefrom, and a second side facing the substance outlet for providing heat to the substrate being provided from the substrate outlet.

When the cartridge is assembled to the base part, the heating element can be separated from the vaporization chamber by the heat transfer unit.

The cartridge can further comprise a porous member interposed between the substance outlet and the heat transfer unit. The porous member can be also interposed between the substance chamber and the vaporization chamber. The porous member and the sorption member can be integrated the same member. The sorption member can at least partially be surrounded by or disposed within the porous member. The porous member can provide protection to the sorption member and/or hold the sorption member. The porous member can be formed as a mesh. The porous member can be made, for example, from stainless steel, or any other similar material which is able to transfer substance.

The vaporization chamber can be interposed between the porous member and the heat transfer unit.

The porous member can have a first surface associated with the substance outlet for absorbing the substance, and a second surface associated with the heat transfer unit, for allowing passage of the substance from the substance chamber to the vaporization chamber. The first surface can be immersed in the substance.

The second surface can be associated with the heat transfer unit by facing the heat transfer unit and can be separated from the heat transfer unit by the vaporization chamber for allowing introduction of the substance from the second surface into the vaporization chamber for its heating and thereby its vaporization.

In accordance with one design embodiment, the arrangement can be such that the second surface of the porous member does not come into direct contact with the heat transfer unit, thereby minimizing any chance of damage to the porous member by the heat transfer unit.

The porous member can be formed with a hole extending therethrough between the first surface and the second surface and establishing fluid communication between the vaporization chamber and a mouthpiece of the cartridge via a vaporization channel, thereby allowing the vaporized substance to escape from the vaporization chamber via the mouthpiece. The hole can constitute at least part of the vaporization chamber.

In accordance with another design embodiment, the second surface of the porous member can be at least partially in direct contact with the heat transfer unit, thereby increasing the efficiency of heat transfer to the sorption member, thereby increasing vaporization of the smoked substance. Under such a design, the heat is delivered from the heat transfer unit to the second surface of the porous member by conduction.

The sorption member can have an elongated form (e.g. a string, strip etc.). The sorption member can be in the form of a flat cap, cover or cushion of soft material. In particular, the sorption member can be sized and shaped to fit the cross-section of one of the vaporization chamber and substance chamber. The porous member can be sized and shaped to fit the cross-section of one of the vaporization chamber and substance chamber.

The cartridge can further comprise: a cartridge housing at least partially including said substance chamber and said vaporization chamber, and a vaporization channel extending along the cartridge housing and in fluid communication with the vaporization chamber. The cartridge housing can have a proximal end configured with a mouthpiece which is in fluid communication with the vaporization chamber via the vaporization channel and a distal end associated with the heat transfer unit. The mouthpiece is configured for providing the vaporized substance to the user. The heat transfer unit can be disposed at the distal end. The heat transfer unit can be perpendicular to the vaporization channel.

The substance chamber can be juxtaposed with the vaporization channel extending between the vaporization chamber and the mouthpiece. The substance chamber can be disposed at the surrounding of the vaporization channel.

The cartridge housing can comprise a first air inlet formed therein for establishing fluid communication between an exterior of the cartridge and the vaporization chamber for allowing passage of air into the vaporization chamber for its vaporization therein with the substance.

The first air inlet can be disposed in proximity to the distal end of the cartridge.

The base part can have a base housing having an interfacing portion associated with the heating element and configured for interfacing the distal end of the cartridge housing when the cartridge is assembled to the base part, so as to bring the heating element into proximity or contact with the heat transfer unit.

The interfacing portion can comprise a second air inlet formed therein, and configured at least when the cartridge is assembled to the base part for establishing fluid communication between an exterior of the electronic cigarette and the vaporization chamber via the first air inlet for allowing passage of air into the vaporization chamber for its vaporization therein with the substance. When the cartridge is assembled to the base part, the first air inlet and the second air inlet can be inline with each other.

In assembly, the cartridge is attached to the base part so that the heat transfer unit comes into contact with the heating element to receive heat therefrom by conduction.

In operation, upon turning on the electrical cigarette, the battery electrically heats the heating element of the base part, which then provides its heat by conduction to the heating element. This, in turn, provides the heat the sorption member, entailing vaporization of the substance absorbed therein.

As this process is continuous, the substance from the substance chamber keeps filling (owing to capillarity absorbing effects) the sorption member, thereby providing a constant supply of substance thereto. Substance vapors created during the above process are forced to escape the cartridge via the vaporization channel leading to the mouthpiece and to the user.

The heat transfer unit can be made of thermally conductive material, for example, metals (e.g., aluminum, copper, etc.).

The cartridge housing can be made of one or more of the following materials: aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), polybutylene terephthalate (PBT), Acrylonitrile butadiene styrene (ABS), Polycarbonates (PC), epoxy resins, polyurethane resins and vinyl resins. The parts of the cartridge housing can be assembled or at least partially overmoulded.

The heating element can be made of an electrically resistive material. The heating element can comprise a non-elastic material, for example a ceramic sintered material, such as alumina (Al2O3) and silicon nitride (S13N4), or printed circuit board or silicon rubber. The heating element can comprise an elastic, metallic material, for example an iron alloy or a nickel-chromium alloy.

The electrically resistive material of the heating element can include one or more of the following materials: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminum-titanium-zirconium-, hafnium-, niobium-, molybdenum-, tantalum-, tungsten-, tin-, gallium- and manganese-alloys, and superalloys based on nickel, iron, cobalt, stainlesssteel, Timetal® and iron-manganese-aluminum based alloys. Timetal® is a registered trademark of Titanium Metals Corporation, 1999 Broadway Suite 4300, Denver, Colo. In composite materials, the electrically resistive material may optionally be embedded in, encapsulated or coated with an insulating material or vice-versa, depending on the kinetics of energy transfer and the external physicochemical properties required.

The heating element may be formed using a metal having a defined relationship between temperature and resistivity. In such embodiments, the metal may be formed as a track between two layers of suitable insulating materials. A heating element formed in this manner may be used both as a heater and a temperature sensor. The heating element can include a temperature sensor embedded therein or attached thereto. The heating element can be at least partially encapsulated in or coated with a protecting material, such as glass.

The battery can be a DC voltage source. For example, the battery can be a Nickel-metal hydride battery, a Nickel cadmium battery, or a Lithium based battery, for example a Lithium-Cobalt, a Lithium-Iron-Phosphate, a Lithium-Ion or a Lithium-Polymer battery.

Throughout the entire process, neither the substance nor the sorption member comes into any contact with the heating element, as they are separated at least by the heat transfer unit. In other words, the second surface of the sorption member heats up owing only to its association with the heat transfer unit.

Such a configuration has at least the following advantages:

- reducing the risk of corrosion process on the heating element, modification of vaporization temperature and decrease in heater efficiency;
- reducing the risk of liquid ingestion with unperfected vaporization process, or heating element with filter addition;
- reducing exposure to fouling, steams properties modifications and cartridge cost increase;
- reducing risk of explosion with unperfected vaporization based on pressure devices; and
- reducing flammability risk with the contact between sorption member and the heating element (as known in the art).

It should also be noted that since the heating element is accommodated within the base part, which is reusable, it allows using a higher-grade heating element, with better safety characteristics and heating capacity and efficiency, something that is not economically viable when the heating element is accommodated within the disposable part (i.e., the cartridge).

In addition, the elimination of contact between the smoked substance and the heating element allows, for all practical purposes, considerably reducing the chance of any residual taste from being transferred between refills/replacements of the cartridge.

The base part can further comprise a processor associated with electrical components of the electronic cigarette, including the battery. The electrical components can be configured for providing additional features to the electronic cigarette, some of which are:

- a sensing unit (e.g., a gyroscope, an accelerometer, a compass, etc.) connected to the processor for identifying movement or position of the electronic cigarette and thereby allow a gesture-based operation thereof. In case of an internal gyroscope, it can be constituted by or supplemented by any other sensor like a compass or an accelerometer configured to detect gestures. For example, the electronic cigarette can be tipped twice to be 'switched-on' and/or waived to the side to indicate switching off; a puff detector based on a microphone or a pressure sensor, connected to processor. In an example in which the puff detector is a microphone, when a user breathes in, it produces a specific vibration used to count puffs. The puff detector can detect the power with which the user breathes and thereby automatically adapt the quantity of the delivered smoked substance;
- cigarette equivalency measure—allowing the processor to determine, based on the number of puffs and length of each puff, what is the estimated number of corresponding 'real life cigarettes' smoked by the user and alert him to the fact. For example, the processor can be configured to provide a signal to the user that he has smoked over ten cigarettes and set an alert. Alternatively, the user may be able to set, in advance, a cigarette limit after which the electronic cigarette shuts down for a predetermined amount of time;
- electronic turns off the cigarette, when the puff number or/and defined puffing time breathed in is equivalent to a defined puff number or/and defined puffing time.

In general, the subject matter of the present application provides at least the following advantages:

- simple flavor replacement by replacing one cartridge with another cartridge;
- contact prevention between the substance in the cartridge, and the heating element, avoiding flavor transfer from one cartridge to another; —prevention of contact between the emerged sorption member and the heating element, decreasing risk roving fire ignition; and
- allowing use of a reusable opened (or ongoing) cartridge.

In accordance with another aspect of the subject matter of the present application, there is provided an electronic cigarette comprising a base part and a cartridge configured to be assembled thereto, said base part comprising a battery, a processor associated with the battery and one or more orientation components associated with the processor, said orientation component being configured for identifying movement, orientation or spatial position of at least the base part and providing data regarding said movement to the processor, based on which said processor is configured for at least turning the battery on/off. It is appreciated that based on different gestures performed by the user, e.g. orienting the electronic cigarette in a certain manner or moving it in a specific direction, the processor can provide additional operational modes of the electronic cigarette, e.g. standby mode, regulation of vapor amount, timed smoking programs, etc. The electronic cigarette can be configured for being turned on by a predetermined shaking motion thereof by a user.

In accordance with yet another aspect of the subject matter of the present application, there is provided an electronic cigarette comprising a base part configured to be assembled to a cartridge including a substance, said base part comprising a battery, and a processor associated with the battery, and at least one sensory component associated with the cartridge and with the processor, said sensory component being configured for obtaining at least one smoking parameter from the cartridge and providing said data to the processor, and wherein said processor is configured, at least during operation of the cigarette, for calculating a second smoking parameter based on said first smoking parameter and provide a corresponding output to either the user or the battery.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
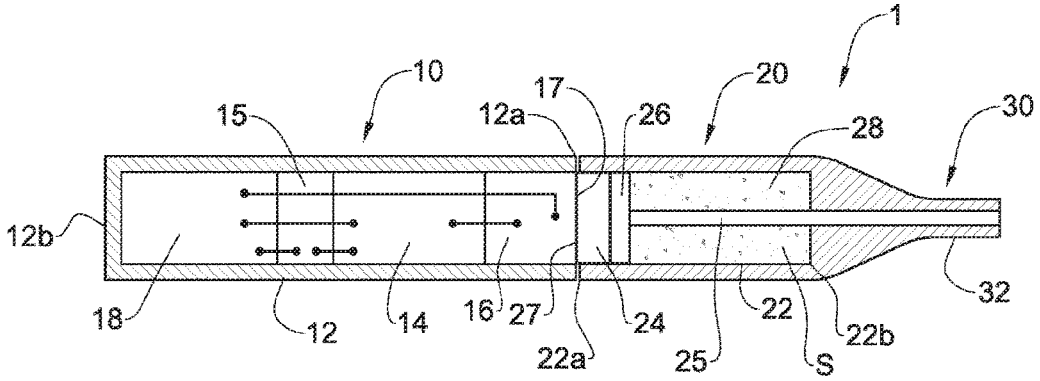
FIG. 1 is a schematic cross-sectional view of an electronic cigarette according to one example of the presently disclosed subject matter.

Attention is first drawn to FIG. 1 in which a schematic cross-section of the electronic cigarette of the present application is shown, generally designated 1 and comprising a base part 10 and a cartridge 20 attached to one another.

The base part 10 comprises a cylindrical housing 12 accommodating therein a battery 14 connected to a heating element 16 located at a first end 12*a* of the housing 12 and having an interface surface 17 configured for matching a corresponding interface surface 27 of the cartridge. The battery 14 is configured for providing the heating element 16 with the necessary power for its operation, allowing it to become heated to a required temperature.

The battery 14 is also connected to a processor unit 18 and a sensor 15, providing the required power for their operation. The processor unit 18 is connected to both the sensor 15 and the heating element 16. Both processor unit 18 and the sensor 15 are located, in this specific example, on an opposite side of the battery 14 to that of the heating element 16, wherein the battery 14 acts as a divider between the heating element 16 and other sensitive components of the electronic cigarette 1. However, this arrangement is not compulsory and any other arrangement of the components within the base part 10 may be applicable.

In addition, the sensor 15 can be configured for identifying movement, orientation and spatial position of at least the base part 10, and providing this information (hereinafter: spatial data) to the processor 18. Based on the spatial data, the processor 18 can determine whether to turn the heating element 16 on/off, and/or if to set a certain operational regime of the electronic cigarette 1, e.g. standby mode, regulation of vapor amount, timed smoking programs etc.

Thus, in operation, upon identification of a predetermined gesture of the user by the sensor 15, this information is provided from the sensor 15 to the processor 18, which then determines, based on said gesture, the proper operational mode of the electronic cigarette 1. Upon determining such a mode, the processor 18, which is directly linked to the heating element 16, provides the latter with the proper operational signal determining the required temperature and heating rate of the heating element 16, while the power for such heating is supplied by the battery 14.

As a result, the electronic cigarette 1 can be configured for being operated using gestures and positions thereof, for example, a double-shake of the electronic cigarette 1 can indicate to the processor to turn the electronic cigarette 1 on/off whereas holding the electronic cigarette 1 in a vertical orientation can indicate the processor to set a 'standby' mode for the electronic cigarette 1. It should be appreciated that the sensor can be of various types (e.g. sound, motion, orientation, acceleration etc.), whereby the gestures required from the user in order to operate the electronic cigarette can change correspondingly, e.g. (knocking the electronic cigarette against a surface, speed of motion eng.).

Figure 2A:
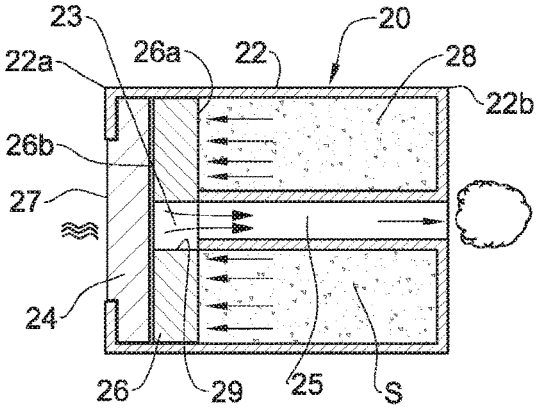
FIG. 2A is a schematic cross-section of one example of a cartridge used in the electronic cigarette shown in FIG. 1.

With additional reference being made to FIG. 2A, the cartridge 20 of the electronic cigarette 1 comprises a cartridge housing 22 accommodating a heat transfer unit 24 located at a distal end 22*a* of the cartridge housing 22 and having the interface surface 27 configured for matching a corresponding interface surface 17 of the heating element 16, when the cartridge 20 is attached to the base 10. At an opposite proximal end 22*b* of the cartridge housing 22, the cartridge 20 comprises a mouthpiece 30, configured for being introduced into a user's mouth (not shown).

The housing 22 is formed with a substance chamber 28 configured for containing therein a flavored substance S to be smoked by the user. The chamber 28 is extending between the proximal end 22*b* and the distal end 22*a*, but is spaced from the distal end 22*a*. The substance chamber 28 surrounds a vaporization chamber 23 formed as hole therein. The vaporization chamber 23 coextends with a vaporization channel 25 which coextends with a mouthpiece channel 32 of the mouthpiece 30.

The housing 20 further accommodates therein a sorption member 26 juxtaposed between the heat transfer unit 24 and the substance chamber 28 The sorption member 26 is configured, on the one hand, for absorbing therein some of the substance S, and, on the other hand, for being heated by the heat transfer unit 24 thereby allowing the substance S absorbed therein to vaporize into the vaporization chamber 23 and escape from the vaporization chamber 23 via the vaporization channel 25 to the user via the mouthpiece 30. Although not shown in FIG. 2A, the vaporization chamber 23 is in fluid communication with the exterior of the electronic cigarette 1 for receiving air thereto when the user inhales the smoked substance via the mouthpiece 30.

In operation, the heating element 16 is heated up by the battery and provides it heat to the heat transfer unit 24 via conduction between the interface surfaces 17, 27. Thus, the sorption member 26 is heated indirectly via the heat transfer unit 24 and not directly via the heating element, leading to considerable advantages in terms of safety, temperature control and reliability of the electronic cigarette 1.

As a result of heating of the sorption member 26, the substance S absorbed therein vaporizes in the vaporization chamber 23 and the vapor escapes the cartridge 20 via the vaporization channel 25 as indicated by the arrows.

It is important to note that in this example, the sorption member 26 takes up substantially all the space between the substance chamber 28 and the heat transfer unit 24 so that it has a first surface 26*a* configured for absorbing the substance S from the substance chamber 28 and a second, opposite surface 26*b* configured for being heated by the heat transfer unit 24.

Figure 2B:
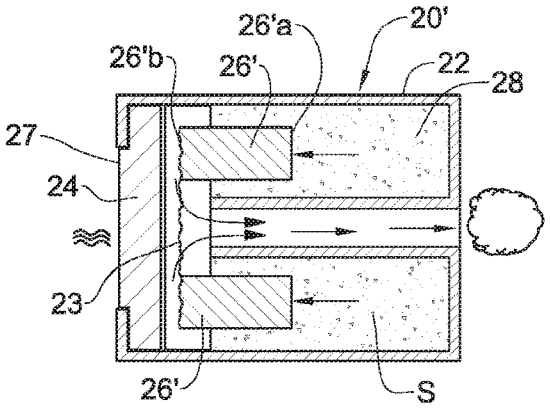
FIG. 2B is a schematic cross-section of another example of a cartridge used in the electronic cigarette shown in FIG. 1.
Figure 2C:
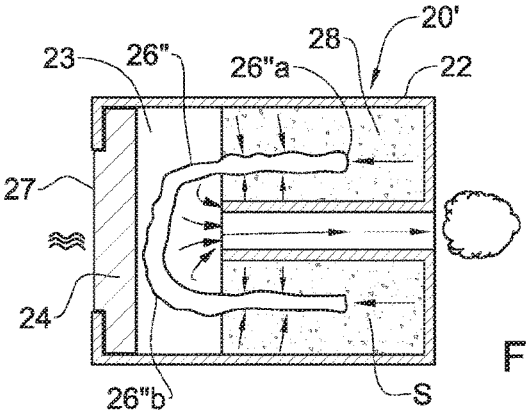
FIG. 2C is a schematic cross-section of yet another example of a cartridge used in the electronic cigarette shown in FIG. 1.

Turning now to FIGS. 2B and 2C, two additional examples of cartridge designs are shown, generally designate 20' and 20" respectively.

In the example shown in FIG. 2B, the sorption member 26' is in the form of a ring having its first side rim 26*a*' disposed within the substance chamber 28 so that it is immersed in the substance S. A second side rim 26*b*' is disposed closer to the heat transfer unit 24 and configured for being heated thereby. It is observed that the sorption member 26' does not occupy the entire space delimited between the substance chamber 28 and the heat transfer unit 24, which constitutes, in this example, a vaporization chamber 23.

Under this example, any substance S being vaporized owing to the heat provided by the heat transfer unit 24 first resides in the vaporization chamber 23 and is gradually and continuously removed therefrom via the channel 25 according to the user's puffs and sucking on the mouthpiece.

With attention being drawn to FIG. 2C, yet another example is shown, generally designated 20" in which, instead of a ring-like sorption member 26', the one used here is a sorption member 26" which has extensions dipped in the substance S contained in the substance chamber 28, gradually absorbing the substance S into the member 26". The operation is similar to that previously described with respect to FIG. 2B.

Figure 3A:
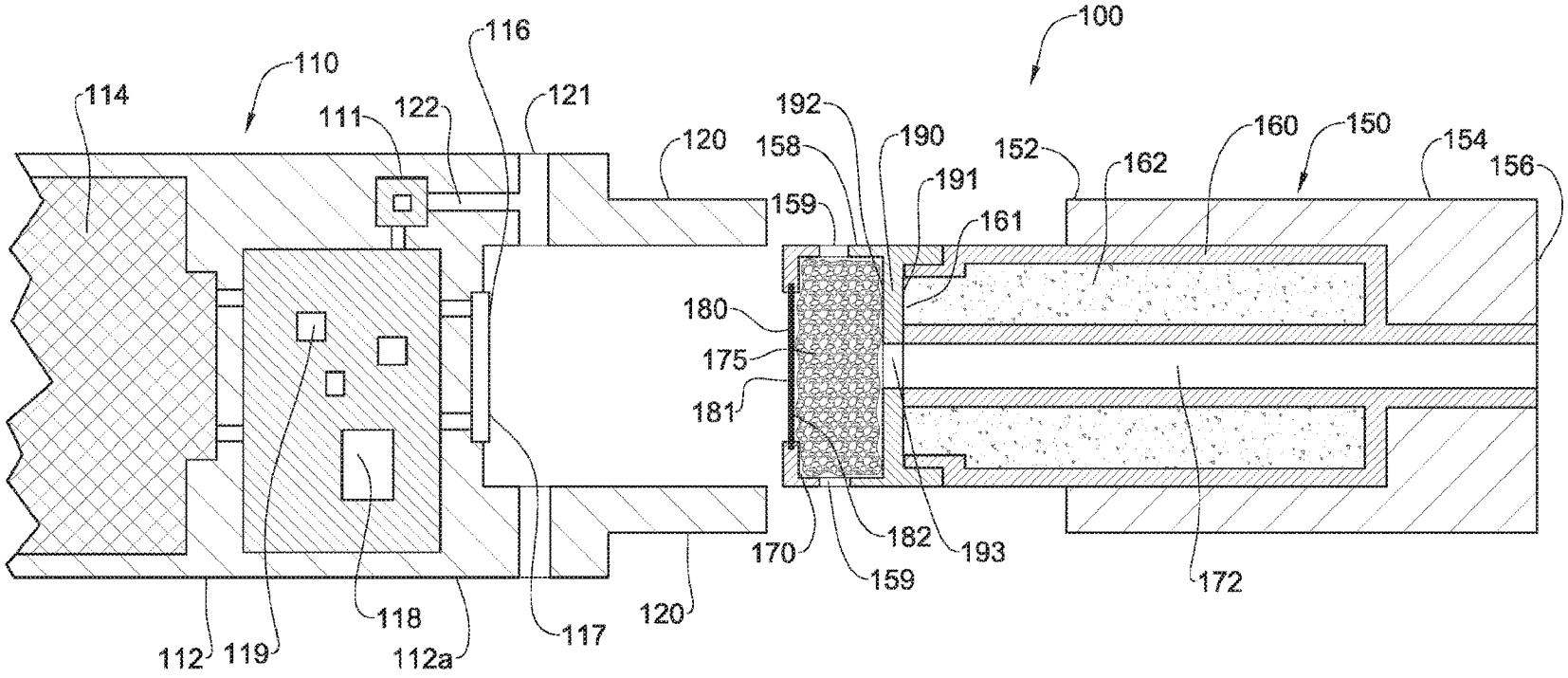
FIG. 3A is a schematic cross-sectional view of a disassembled electronic cigarette according to another example of the present disclosed subject matter.
Figure 3B:
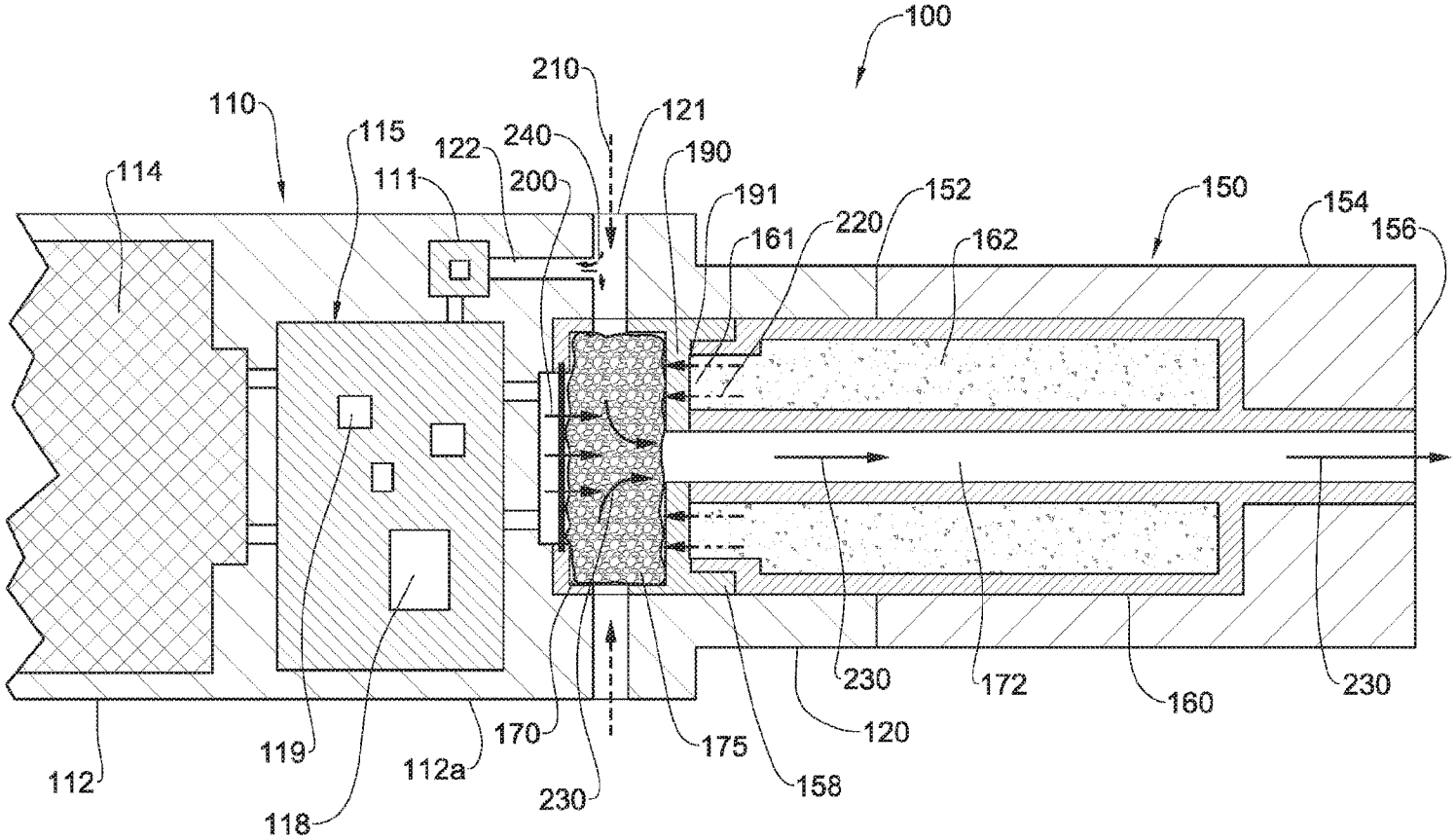
FIG. 3B is a schematic cross-sectional view of the electronic cigarette of FIG. 3A in its assembled form.

Reference is now made to FIGS. 3A and 3B, illustrating a cross-sectional view of another example of an electronic cigarette, generally designated 100 and comprising a base part 110 and a cartridge 150. In FIG. 3A the base part 110 and the cartridge 150 are assembled to each other, and being operated by a user.

The base part 110 comprises a cylindrical base housing 112 accommodating therein a battery 114 connected to a heating element 116 located at a first end 112*a* of the base housing 112 and having an interface surface 117. The battery 114 is configured for providing the heating element 116 with the necessary power for its operation, allowing it to become heated to a required temperature.

The cartridge 150 is structured of a cartridge housing 152 having a proximal end 154 with a mouthpiece 156 configured for being introduced into a user's mouth (not shown), and a distal end 158 configured to be introduced into the first end 112*a* of the base housing 110. The cartridge housing 152 includes a substance chamber 160 extending along its length and containing therein a substance 162 to be smoked. The substance chamber has a substance outlet 161 disposed at the distal end 158 of the cartridge housing 150, and configured for allowing the substance 162 to escape from the substance chamber 160.

The cartridge housing 152 further comprises a vaporization chamber 170 in communication with the substance outlet 161 for receiving the substance 162 therein, and a heat transfer unit 180 configured, when the cartridge is assembled to the base part 110, for being heated by the heating element 116 of the base part 110 and for heating the substance 162 being provided via the substance outlet 161 for its vaporization in the vaporization chamber 170. The vaporization chamber 170 is in fluid communication with a vaporization channel 172 extending from the vaporization chamber 170 to the mouthpiece 156. The vaporization chamber 170 coextends with the substance chamber 160, while the substance chamber 160 fully surrounds the vaporization channel 172. The heat transfer unit 180 is perpendicular to the vaporization channel 172. The heating element can include a temperature sensor (not shown) attached thereto or integrated therein for providing a signal determining the required temperature and heating rate of the heating element 116, while the power for such heating is supplied by the battery 114.

The heat transfer unit 180 has a first side 181 configured, when the cartridge 150 is assembled to the base part 110, for interfacing a heating surface 117 of the heating element 116 for receiving heat therefrom, and an opposite second side 182 facing the vaporization chamber 170 for providing heat to the substrate being provided from the substrate outlet 161.

The base housing 112 has an interfacing portion 120 disposed in proximity to the heating element 116 and configured for interfacing the distal end 158 of the cartridge housing 152 when the cartridge 150 is assembled to the base part 110, so as to bring the heating element 116 to contact with the heat transfer unit 180. In particular, in assembly of the cartridge 150 with the base part 110, the heating surface 117 is fully matched with the first side 181 of the heat transfer unit 180 for transferring heat from the heating element 116 to the heat transfer unit 180, and from the heat transfer unit 180 via the second side 182 to the vaporization chamber 170 in which the smoked substance is heated and vaporized. The configuration of the electronic cigarette is thus such that when the cartridge 150 is assembled to the base part 110, the heating element 116 is separated from the vaporization chamber 170 by the heat transfer unit 180.

The cartridge housing 154 further comprises a first air inlet 159 formed at the distal end 158 for establishing fluid communication between an exterior of the cartridge 150 and the vaporization chamber 170 for allowing passage of air into the vaporization chamber 170 for its vaporization therein with the substance 162 being supplied via the substance outlet 161.

The interfacing portion 120 comprises a second air inlet 121 formed therein, and configured when the cartridge 150 is assembled to the base part 110 for establishing fluid communication between an exterior of the electronic cigarette 100 and the vaporization chamber 170 via the first air inlet 159 for allowing passage of air into the vaporization chamber 170 for its vaporization therein with the substance 162 being supplied via the substance outlet 161. As shown in FIG. 3*b*, when the cartridge 150 is assembled to the base part 110, said first air inlet 159 and said second air inlet 121 are inline with each other.

The vaporization chamber 170 includes a sorption member 175 disposed therein. The sorption member 175 is configured, on the one hand, for absorbing some of the substance 162, and, on the other hand, for being heated by the heat transfer unit 180 thereby allowing the substance 162 absorbed therein to vaporize into the vaporization chamber 170 and escape from the vaporization chamber 170 via the vaporization channel 172 to the user via the mouthpiece 156.

The cartridge housing 152 further comprises a porous member 190 interposed between the substance outlet 161 and the vaporization chamber 170, so that the vaporization chamber 170 is interposed between the porous member 190 and the heat transfer unit 180. The porous member 190 has a first surface 191 facing the substance outlet 161 and an opposite second surface 192 facing the sorption member 175 in the vaporization chamber 170, for allowing passage of the substance 162 from said substance chamber 160 to the sorption member 175. The second surface 192 is associated with the heat transfer unit 180 by facing its second side 182 and is separated from the heat transfer unit 180 by said vaporization chamber 170 for allowing introduction of the substance 160 from the second surface 192 into the sorption member 175 in the vaporization chamber 170 for its heating and thereby its vaporization therein. The porous member 190 is sized and shaped to fit the cross-section of the distal end 158 of the cartridge housing 154.

The porous member 190 is formed with a hole 193 extending therethrough between the first surface 191 and the second surface 192 and establishing fluid communication between the vaporization chamber 170 and the mouthpiece 156 via the vaporization channel 172, thereby allowing the vaporized substance to escape from the vaporization chamber 170, and in particular, from the sorption member 175 via the mouthpiece 156 during smoking the vaporized substance by the user. During operation of the electronic cigarette 100, the heat is configured to be delivered from the heat transfer unit 180 to the sorption member 175 by conduction.

It should be indicated that according to other examples, the sorption member 175 and the porous member 190 can be integrated in the same member, so that the sorption member is in direct contact with the substance outlet 161.

Reference is now made specifically to FIG. 3B to explain the manner of operation of the electronic cigarette 100 during use by a user. In operation, the heating element 116 is heated up by the battery 114 and provides heat from its heating surface 117 to the first side 181 of the heat transfer unit 180 via 24 by conduction. The heat from the heat transfer unit is designated by an arrow 200. During use of the electronic cigarette 100 by a user, the user inhales air which is provided to the vaporization chamber 170, and in particular, to the sorption member 175 via the second air inlet 121 and the first air inlet 159, and designated by an arrow 210. Simultaneously, the smoked substance 160 is provided via the second surface 192 of the porous member 190 to the vaporization chamber 170 as well, and this substance is designated by an arrow 220. The smoked substance 220 is mixed with the air 210 and heated by the heat 200 is the vaporization chamber 170. The heating of the air 210 and the smoked substance 220 results in their vaporization in the sorption member 175 within the vaporization chamber 170. The vaporized substance, which is designated by an arrow 230, is afterwards transferred via the vaporization channel 172 to the mouthpiece 156, and from there to the user.

During the above operation, the sorption member 175 is heated indirectly via the heat transfer unit 180 and not directly via the heating element 116, leading to considerable advantages in terms of safety, temperature control and reliability of the electronic cigarette 100.

The battery 114 is also connected to an electronic unit 115 including a processor 118 and a sensing unit 119, for providing the required power for operation of the electronic unit 115 and its components. The processor 118 is connected to both the sensing unit 119 and the heating element 116. The sensing unit 119 can be configured for identifying movement, orientation and spatial position of at least the base part 110, and providing this information (hereinafter: spatial data) to the processor 118. Based on the spatial data, the processor 118 can determine whether to turn the heating element 116 on/off, and/or if to set a certain operational regime of the electronic cigarette 100, e.g. standby mode, regulation of vapor amount, timed smoking programs etc.

Thus, in operation, upon identification of a predetermined gesture of the user by the sensing unit 119, this information is provided from the sensing unit 119 to the processor 118, which then determines, based on said gesture, the proper operational mode of the electronic cigarette 100. Upon determining such a mode, the processor 118, which is directly linked to the heating element 116, provides the latter with the proper operational signal determining the required temperature and heating rate of the heating element 116, while the power for such heating is supplied by the battery 114.

As a result, the electronic cigarette 100 can be configured for being operated using gestures and positions thereof, for example, a double-shake of the electronic cigarette 100 can indicate to the processor to turn the electronic cigarette 100 on/off whereas holding the electronic cigarette 100 in a vertical orientation can indicate the processor to set a 'standby' mode for the electronic cigarette 100. It should be appreciated that the sensing unit 119 can include various types of sensors (e.g. sound, motion, orientation, acceleration etc.), whereby the gestures required from the user in order to operate the electronic cigarette 100 can change correspondingly, e.g. (knocking the electronic cigarette against a surface, speed of motion eng.).

The base part 110 further comprises a puff detector 111 (e.g., a pressure sensor or a microphone), connected to the processor 118 for providing puff detection. The puff detector 111 is disposed in fluid communication with the second air inlet 121 via a third air inlet 122, so that when air 210 passes along the second air inlet 210, it also enters into the third air inlet 122. The air that passes along the third air inlet 122 is shown in FIG. 3B by arrows 240. During operation of the electronic cigarette, the puff detector 111 and the processor 118 are configured to identify air pressure changes of the air 240, and performing different operations respectively. This operation includes, for example, counting puffs for various purposes, turning off the cigarette when the puff number breathed is equivalent to a defined puff number and/or puffing time, and detecting the power with which the user breathes and thereby automatically adapting the quantity of the delivered smoked substance. The information provided by the puff detector 111 can allow the processor 118 to determine, based on the number of puffs and length of each puff, what is the estimated number of corresponding 'real life cigarettes' smoked by the user and alert him to the fact. For example, the processor 118 can be configured to provide a signal to the user that he has smoked over ten cigarettes and set an alert. Alternatively, the user may be able to set, in advance, a cigarette limit after which the electronic cigarette shuts down for a predetermined amount of time.

Those skilled in the art to which this invention pertains will readily appreciate that numerous changes, variations, and modifications can be made without departing from the scope of the invention, mutatis mutandis.

The invention claimed is:

1. An electronic cigarette comprising a base part and a cartridge configured to be assembled thereto, said base part comprising a battery and at least one heating element connected to the battery, and said cartridge comprising:

a substance chamber configured for containing therein a substance to be smoked, said substance chamber comprising a substance outlet;

a vaporization chamber in communication with the substance outlet for receiving said substance therein; and at least one heat transfer unit configured, at least when the cartridge is assembled to the base part, for contacting and being heated by the heating element of the base part and for heating the substance being provided via said substance outlet for its vaporization in the vaporization chamber, wherein the cartridge further comprises a porous member interposed between the substance outlet and the vaporization chamber, and configured for allowing passage of said substance from said substance chamber to said vaporization chamber.

2. The electronic cigarette according to claim 1, wherein the cartridge further comprises a sorption member at least partially disposed within the vaporization chamber.

3. The electronic cigarette according to claim 1, wherein the heat transfer unit has a first side configured, when the cartridge is assembled to the base part, for interfacing the heating element for receiving heat therefrom, and a second side facing the substance outlet for providing heat to the substance being provided from the substance outlet.

4. The electronic cigarette according to claim 1, wherein said vaporization chamber is interposed between the porous member and the heat transfer unit.

5. The electronic cigarette according to claim 1, wherein the porous member has a first surface facing the substance outlet, and a second surface facing the heat transfer unit.

6. The electronic cigarette according to claim 5, wherein the porous member is formed with a hole extending therethrough between the first surface and the second surface and establishing fluid communication between the vaporization chamber and a mouthpiece of the cartridge via a vaporization channel, thereby allowing the vaporized substance to escape from the vaporization chamber via the mouthpiece.

7. The electronic cigarette according to claim 1, wherein the porous member is sized and shaped to fit the cross-section of one of the vaporization chamber and the substance chamber.

8. The electronic cigarette according to claim 1, wherein the cartridge further comprises: a cartridge housing at least partially including said substance chamber and said vaporization chamber, and a vaporization channel extending along the cartridge housing and in fluid communication with the vaporization chamber; and wherein the cartridge housing has a proximal end configured with a mouthpiece which is in fluid communication with the vaporization chamber via the vaporization channel and a distal end associated with the heat transfer unit.

9. The electronic cigarette according to claim 8, wherein said heat transfer unit is disposed at said distal end.

10. The electronic cigarette according to claim 8, wherein said heat transfer unit is perpendicular to the vaporization channel.

11. The electronic cigarette according to claim 8, wherein said cartridge housing comprises a first air inlet formed therein for establishing fluid communication between an exterior of the cartridge and the vaporization chamber for allowing passage of air into the vaporization chamber for its vaporization therein with the substance.

12. The electronic cigarette according to claim 11, wherein said first air inlet is disposed in proximity to the distal end of the cartridge.

13. The electronic cigarette according to claim 8, wherein the base part has a base housing having an interfacing portion associated with the heating element and configured for interfacing the distal end of the cartridge housing when the cartridge is assembled to the base part, so as to bring the heating element into proximity or contact with the heat transfer unit.

14. The electronic cigarette according to claim 13, wherein said cartridge housing comprises a first air inlet formed therein for establishing fluid communication between an exterior of the cartridge and the vaporization chamber for allowing passage of air into the vaporization chamber for its vaporization therein with the substance, and wherein said interfacing portion comprises a second air inlet formed therein, and configured at least when the cartridge is assembled to the base part for establishing fluid communication between an exterior of the electronic cigarette and the vaporization chamber via the first air inlet for allowing passage of air into the vaporization chamber for its vaporization therein with the substance.

15. The electronic cigarette according to claim 14, wherein, when the cartridge is assembled to the base part, said first air inlet and said second air inlet are inline with each other.

16. The electronic cigarette according to claim 1, wherein the battery is configured for electrically heating the heating element of the base part, to provide its heat by conduction to the heat transfer unit.

17. The electronic cigarette according to claim 1, wherein the base part further comprises a processor associated with electrical components of the electronic cigarette, including said battery.

18. The electronic cigarette according to claim 17, wherein the base part further comprises a sensing unit connected to the processor for identifying movement or positioning of the electronic cigarette to thereby allow a gesture-based operation of the electronic cigarette.

19. The electronic cigarette according to claim 17, wherein the base part comprises a pressure sensor or a microphone, connected to the processor, for providing puff detection.

20. The electronic cigarette according to claim 19, wherein the processor is configured for turning off the cigarette when the puff number breathed in is equivalent to a defined puff number and/or puffing time.

* * * * *